US010138898B2

(12) United States Patent
Bessho

(10) Patent No.: US 10,138,898 B2
(45) Date of Patent: Nov. 27, 2018

(54) CENTRIFUGAL COMPRESSOR AND TURBOCHARGER

(71) Applicant: IHI Corporation, Koto-ku (JP)

(72) Inventor: Yasutaka Bessho, Tokyo (JP)

(73) Assignee: IHI Corporation, Koto-ku (JP)

( * ) Notice: Subject to any disclaimer, the term of this patent is extended or adjusted under 35 U.S.C. 154(b) by 226 days.

(21) Appl. No.: 14/955,606

(22) Filed: Dec. 1, 2015

(65) Prior Publication Data

US 2016/0138608 A1 May 19, 2016

Related U.S. Application Data

(63) Continuation of application No. PCT/JP2014/070024, filed on Jul. 30, 2014.

(30) Foreign Application Priority Data

Aug. 6, 2013 (JP) ..... 2013-162985

(51) Int. Cl.

| | |
|---|---|
| ***F04D 29/44*** | (2006.01) |
| ***F04D 29/68*** | (2006.01) |
| ***F02B 33/40*** | (2006.01) |
| ***F04D 17/10*** | (2006.01) |
| ***F04D 29/28*** | (2006.01) |
| ***F04D 29/42*** | (2006.01) |

(52) U.S. Cl.

CPC ..... *F04D 29/441* (2013.01); *F02B 33/40* (2013.01); *F04D 17/10* (2013.01); *F04D 29/284* (2013.01); *F04D 29/4233* (2013.01); *F04D 29/681* (2013.01); *F05D 2250/294* (2013.01); *F05D 2250/712* (2013.01)

(58) Field of Classification Search

CPC ... F04D 29/441; F04D 29/284; F04D 29/4233

See application file for complete search history.

(56) References Cited

U.S. PATENT DOCUMENTS

| | | | | |
|---|---|---|---|---|
| 5,624,229 | A | 4/1997 | Kotzur et al. | |
| 9,482,240 | B2 * | 11/2016 | Gerard | F04D 1/00 |
| 2007/0196206 | A1 | 8/2007 | Martin et al. | |
| 2008/0138200 | A1 | 6/2008 | Umeyama et al. | |

(Continued)

FOREIGN PATENT DOCUMENTS

| | | | |
|---|---|---|---|
| CN | 1461893 | A | 12/2003 |
| CN | 101220819 | A | 7/2008 |

(Continued)

OTHER PUBLICATIONS

International Search Report dated Nov. 18, 2014 in PCT/JP2014/070024 filed Jul. 30, 2014 (with English translation).

(Continued)

*Primary Examiner* — Justin Seabe

(74) *Attorney, Agent, or Firm* — Oblon, McClelland, Maier & Neustadt, L.L.P.

(57) ABSTRACT

An annular diffuser is formed on an outlet side of a wheel in a housing. A spiral scroll is formed on an outlet side of the diffuser in the housing. An annular concave part is formed to be depressed to an inside in a radial direction in a boundary between a shroud-side wall surface of the diffuser and a wall surface of the scroll.

5 Claims, 7 Drawing Sheets

(56) References Cited

U.S. PATENT DOCUMENTS

| | | | | |
|---|---|---|---|---|
| 2010/0135769 | A1* | 6/2010 | Kleynhans | F04D 29/284 415/58.4 |
| 2010/0260595 | A1 | 10/2010 | Gottemoller et al. | |
| 2011/0091323 | A1* | 4/2011 | Koike | F04D 29/284 416/175 |
| 2012/0171030 | A1* | 7/2012 | Iino | F04D 29/441 415/211.2 |

FOREIGN PATENT DOCUMENTS

| | | | | |
|---|---|---|---|---|
| CN | 101341341 | A | 1/2009 | |
| CN | 102182710 | A | 9/2011 | |
| CN | 104343477 | A | 2/2015 | |
| DE | 4125487 | C1 * | 6/1992 | F04D 27/0207 |
| EP | 2 832 974 | A1 | 2/2015 | |
| FR | 999.797 | A | 2/1952 | |
| JP | 08-503284 | | 4/1996 | |
| JP | 09-280196 | | 10/1997 | |
| JP | 2006-220053 | | 8/2006 | |
| JP | 2008-144615 | | 6/2008 | |
| JP | 2008-175124 | A | 7/2008 | |
| JP | 4146371 | | 9/2008 | |
| JP | 2009-002305 | | 1/2009 | |
| JP | 2010-196542 | | 9/2010 | |
| JP | 2012-184758 | | 9/2012 | |
| JP | 2012-241558 | | 12/2012 | |
| WO | WO 2007/098363 | A1 | 8/2007 | |

OTHER PUBLICATIONS

Written Opinion International Search Report dated Nov. 18, 2014 in PCT/JP2014/070024 filed Jul. 30, 2014.

Extended European Search Report dated Jul. 19, 2016 in Patent Application No. 14834821.2.

Combined Chinese Office Action and Search Report dated Sep. 28, 2016 in Patent Application No. 201480033384.5 (with English translation of categories of cited documents).

* cited by examiner 9
35
37
27
27h
27s
29
7
7s
23
31w
α
β
δ
L
R

CENTRIFUGAL COMPRESSOR AND TURBOCHARGER

CROSS REFERENCE TO RELATED APPLICATIONS

This application is a continuation application of International Application No. PCT/JP2014/070024, filed on Jul. 30, 2014, which claims priority to Japanese Patent Application No. 2013-162985, filed on Aug. 6, 2013, the entire contents of which are incorporated by reference herein.

BACKGROUND

1. Technical Field

The present disclosure relates to a centrifugal compressor that compresses a fluid (gas, such as air, is included) utilizing a centrifugal force and, in particular, to a periphery of a diffuser in the centrifugal compressor.

2. Description of the Related Art

In recent years, various research and development of a centrifugal compressor used for a turbocharger, a gas turbine, an industrial air facility, etc. have been conducted (refer to Japanese Patent Laid-Open Publication Nos. 2009-2305, 2006-220053, and 2010-196542).

A general centrifugal compressor includes a housing. The housing has a shroud thereinside. In the housing, a wheel (an impeller) is rotatably provided around an axial center thereof. The wheel includes a disk. A hub surface of the disk extends from one side in an axial direction toward an outside in a radial direction of the turbine wheel. On the hub surface of the disk, a plurality of blades is integrally provided spaced apart from each other in a peripheral direction. A tip edge of each blade extends along the shroud of the housing.

An annular diffuser (a diffuser flow passage) that decreases a velocity of a compressed fluid (a compression fluid) to thereby raise a pressure thereof is formed on an outlet side of the wheel in the housing. In addition, a scroll (a scroll flow passage) that communicates with the diffuser is formed on an outlet side of the diffuser in the housing.

SUMMARY

By the way, flow separation (a separation vortex) associated with rapid change of a flow passage shape is generated on an outlet side of a shroud-side wall surface of the diffuser during operation of the centrifugal compressor. Meanwhile, when the flow separation develops, an effective flow passage area in the outlet side of the diffuser decreases. As a result, a velocity of a flow of a main flow cannot be sufficiently decreased by the diffuser, and static pressure recovery performance of the diffuser deteriorates. In addition, turbulence occurs in a flow in a discharge port (a discharge flow passage) located on a downstream side of the scroll by collision (interference) of a low pressure part (a blockage, a low pressure region, or a block region) and the flow of the main flow in the scroll due to the flow separation in the outlet side of the shroud-side wall surface of the diffuser, and compressor efficiency of the centrifugal compressor deteriorates.

Consequently, an object of the present disclosure is to provide a centrifugal compressor and a turbocharger that can solve the above-mentioned problems.

A first aspect of the present disclosure is a centrifugal compressor that compresses a fluid (gas, such as air, is included) utilizing a centrifugal force, the centrifugal compressor including: a housing having a shroud thereinside; a wheel rotatably provided in the housing; a diffuser (a diffuser flow passage) formed outside in a radial direction of an outlet side of the wheel in the housing; and a scroll (a scroll flow passage) that is formed on an outlet side of the diffuser in the housing, and communicates with the diffuser, in which a concave part is formed to be depressed to an inside in a radial direction in a boundary (a boundary part) between a shroud-side wall surface of the diffuser and a wall surface of the scroll.

Note that in the specification and claims of the present application, "being provided" means including being indirectly provided through another member in addition to being directly provided, and that "being integrally provided" means including being integrally formed. In addition, an "axial direction" means an axial direction of a wheel, and a "radial direction" means a radial direction of the wheel. Further, a "shroud-side wall surface" means a wall surface located on a side of a surface in which a shroud of a housing has extended outside in the radial direction.

A second aspect of the present disclosure is a turbocharger, the turbocharger including the centrifugal compressor according to the first aspect.

According to the present disclosure, a low pressure part due to separation of an outlet side of the shroud-side wall surface of the diffuser, i.e., the separation itself can be kept away from a flow of a main flow in the diffuser during operation of the centrifugal compressor. Therefore, decrease of an effective flow passage area of the outlet side of the diffuser is suppressed, and a velocity of the flow of the main flow can be sufficiently decreased by the diffuser. In addition, separation of the low pressure part due to flow separation can be kept away from the flow of the main flow in the scroll in the outlet side of the shroud-side wall surface of the diffuser. Therefore, collision (interference) of the low pressure part and the flow of the main flow in the scroll can be lessened to thereby suppress turbulence of the flow of the main flow in a downstream side of the scroll. Consequently, according to the present disclosure, improvement in compressor efficiency of the centrifugal compressor can be achieved, while enhancing static pressure recovery performance of the diffuser.

BRIEF DESCRIPTION OF THE DRAWINGS

FIG. 5A shows a case of the inventive example, FIG. 5B shows a case of the comparative example.

FIG. 6A shows the case of the inventive example, FIG. 6B shows the case of the comparative example.

DESCRIPTION OF THE EMBODIMENTS

The present disclosure is based on a new knowledge mentioned below.

Figure 4B:
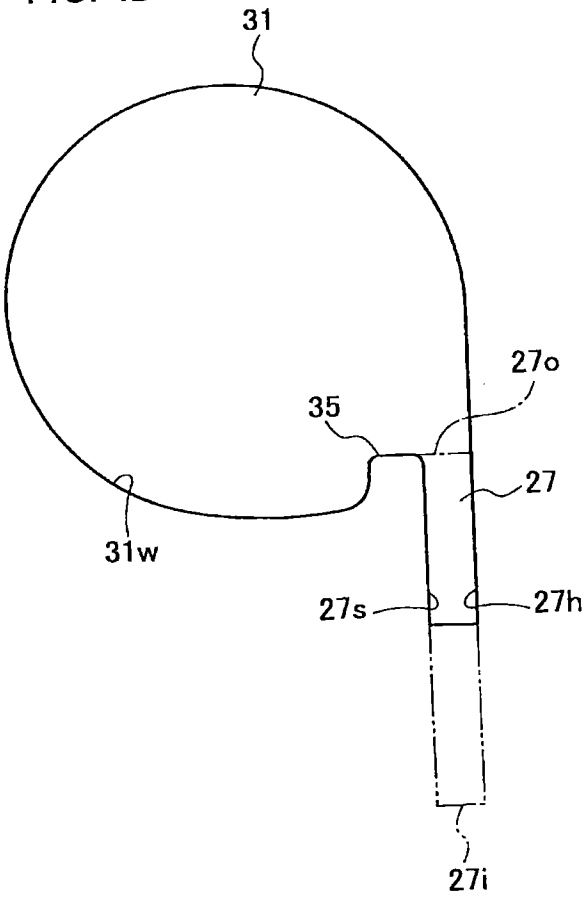
FIG. 4B is a schematic view showing a configuration around a diffuser according to a comparative example.
Figure 4A:
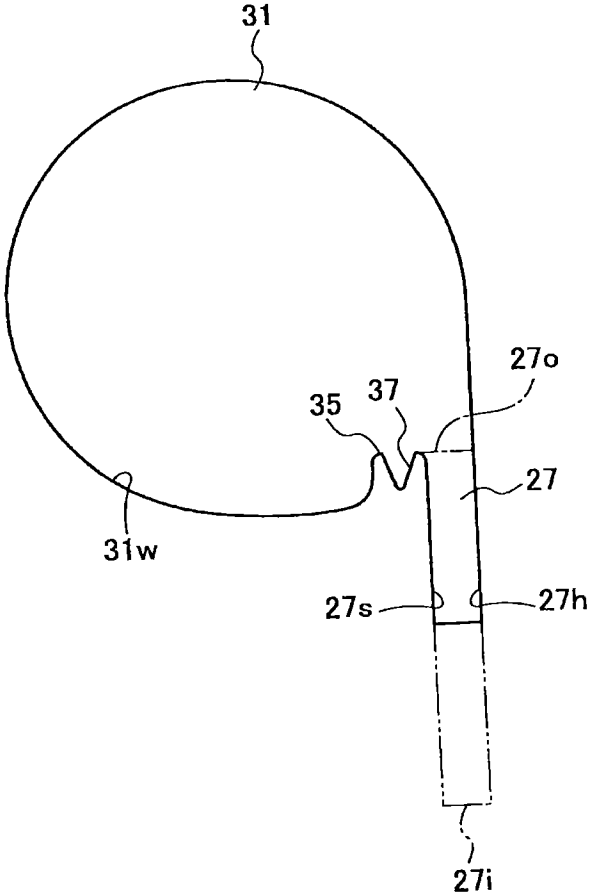
FIG. 4A is a schematic view showing a configuration around a diffuser according to an inventive example.
Figure 5B:
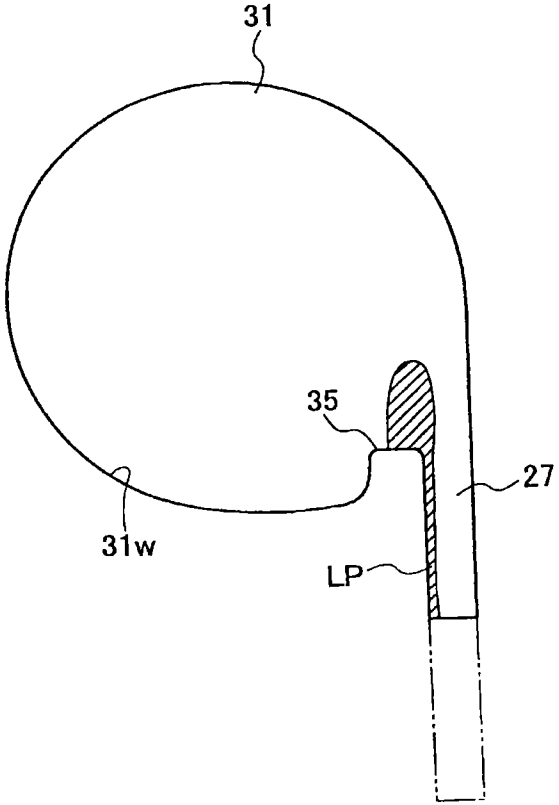
FIGS. 5A and 5B are views each showing a region where a low pressure part is generated in an actuating region of a large flow rate side (a choke side).
Figure 5A:
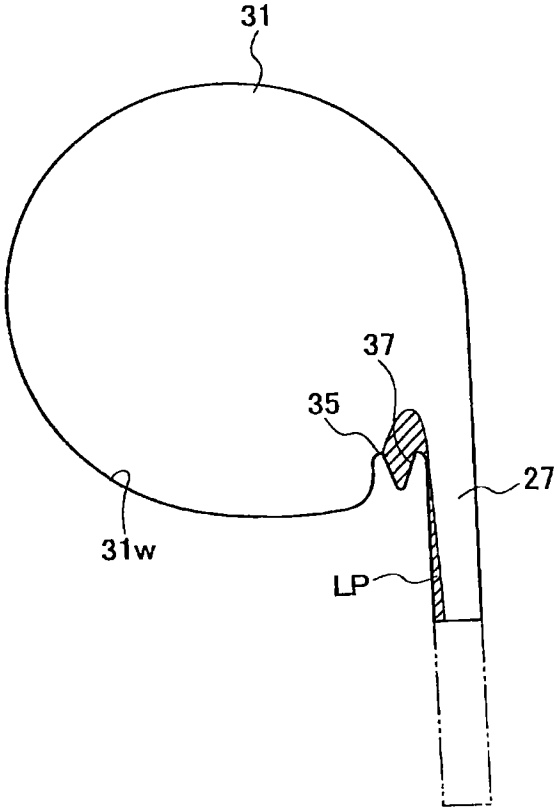

Namely, the new knowledge is that in a case where an annular concave part 37 is formed to be depressed to an inside in a radial direction in a boundary (a boundary part) 35 between a shroud-side wall surface 27*s* of a diffuser 27 and a wall surface 31*w* of a scroll 31 (refer to FIG. 4A), compared with a case where the annular concave part 37 is not formed (refer to FIG. 4B), a part of a low pressure part LP due to flow separation (a separation vortex) enters an inside of the annular concave part 37 in an outlet 27*o* side of the diffuser 27 in the shroud-side wall surface 27*s* during operation of a centrifugal compressor as shown in FIGS. 5A and 5B, and thereby the low pressure part LP can be kept away from a flow of a main flow (a flow center line of the main flow) in the diffuser 27 and the scroll 31. It is considered that entering of the part of the low pressure part LP to the inside of the annular concave part 37 is caused by a pressure difference between an inside of the scroll 31 (an outside part in a radial direction in the scroll 31) and the inside of the concave part 37 in addition to the flow itself of the main flow in the scroll 31. Note that a symbol 27*i* in FIGS. 4A and 4B denotes an inlet of the diffuser 27 that communicates with a housing chamber (refer to FIG. 1) of a wheel (an impeller) 13. In addition, the concave part 37 need not be a continuous annular shape and, for example, the concave part may be provided only in a particular region in a peripheral direction where the low pressure part LP remarkably appears. However, machining becomes easy when the concave part 37 is formed annularly.

Here, FIG. 4A is a schematic view showing a configuration around the diffuser 27 according to an inventive example. FIG. 4B is a schematic view showing a configuration around the diffuser 27 according to a comparative example. FIGS. 5A and 5B are views each showing a region where a low pressure part is generated in an actuating region of a large flow rate side (a choke side). FIG. 5A shows the case of the inventive example, FIG. 5B shows the case of the comparative example. In addition, the region where the low pressure part LP is generated is determined by CFD (Computational Fluid Dynamics) analysis. Further, although illustration is omitted, similar analysis results could be obtained not only in the actuating region of the large flow rate side but also in actuating regions of a small flow rate side (a surge side) and near a peak of compressor efficiency.

An embodiment of the present disclosure will be explained with reference to FIGS. 1 to 3. Note that "L" is a left direction, and "R" is a right direction as shown in the drawings.

Figure 1:
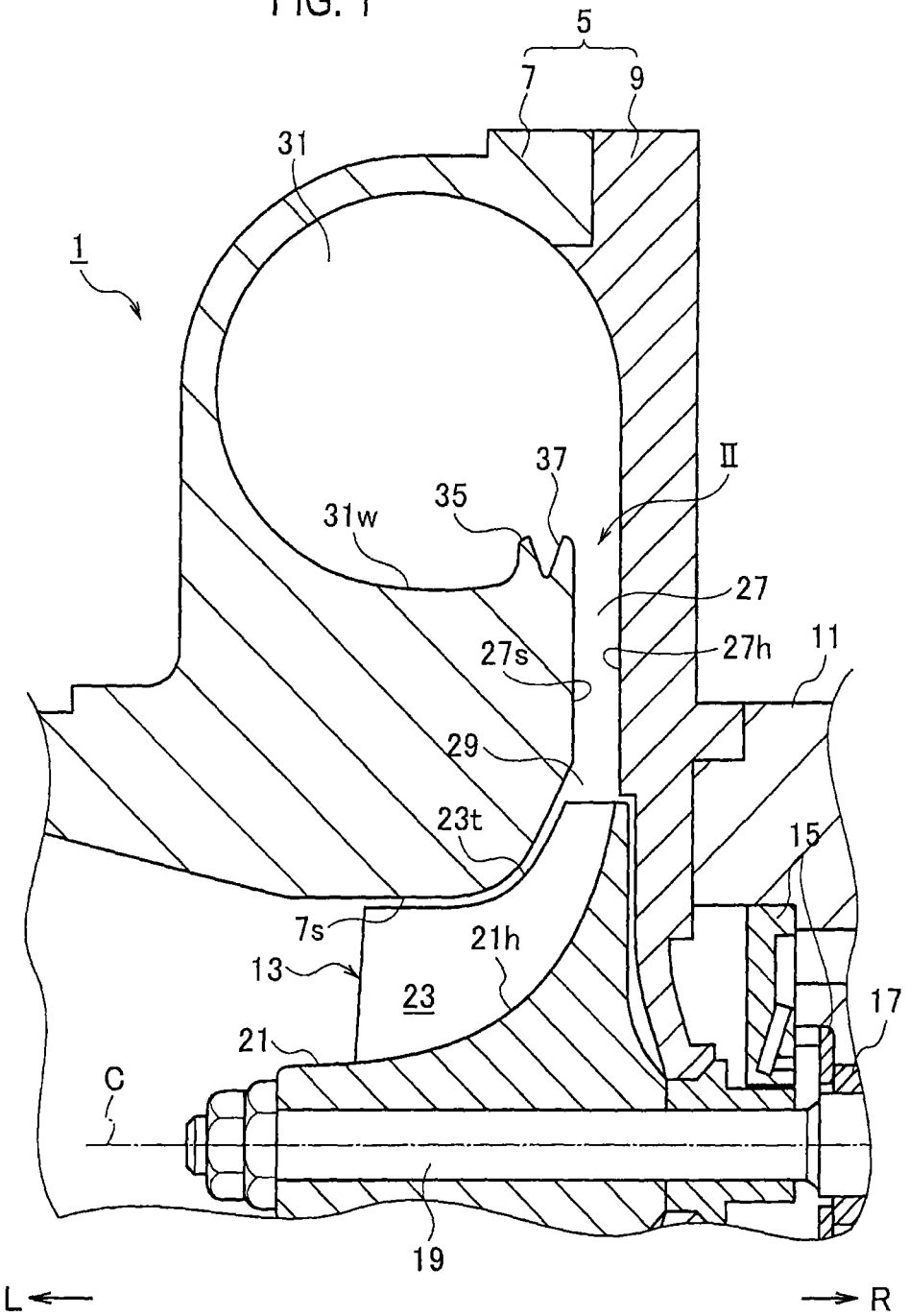
FIG. 1 is an enlarged view of an arrow part I in FIG. 3.
Figure 3:
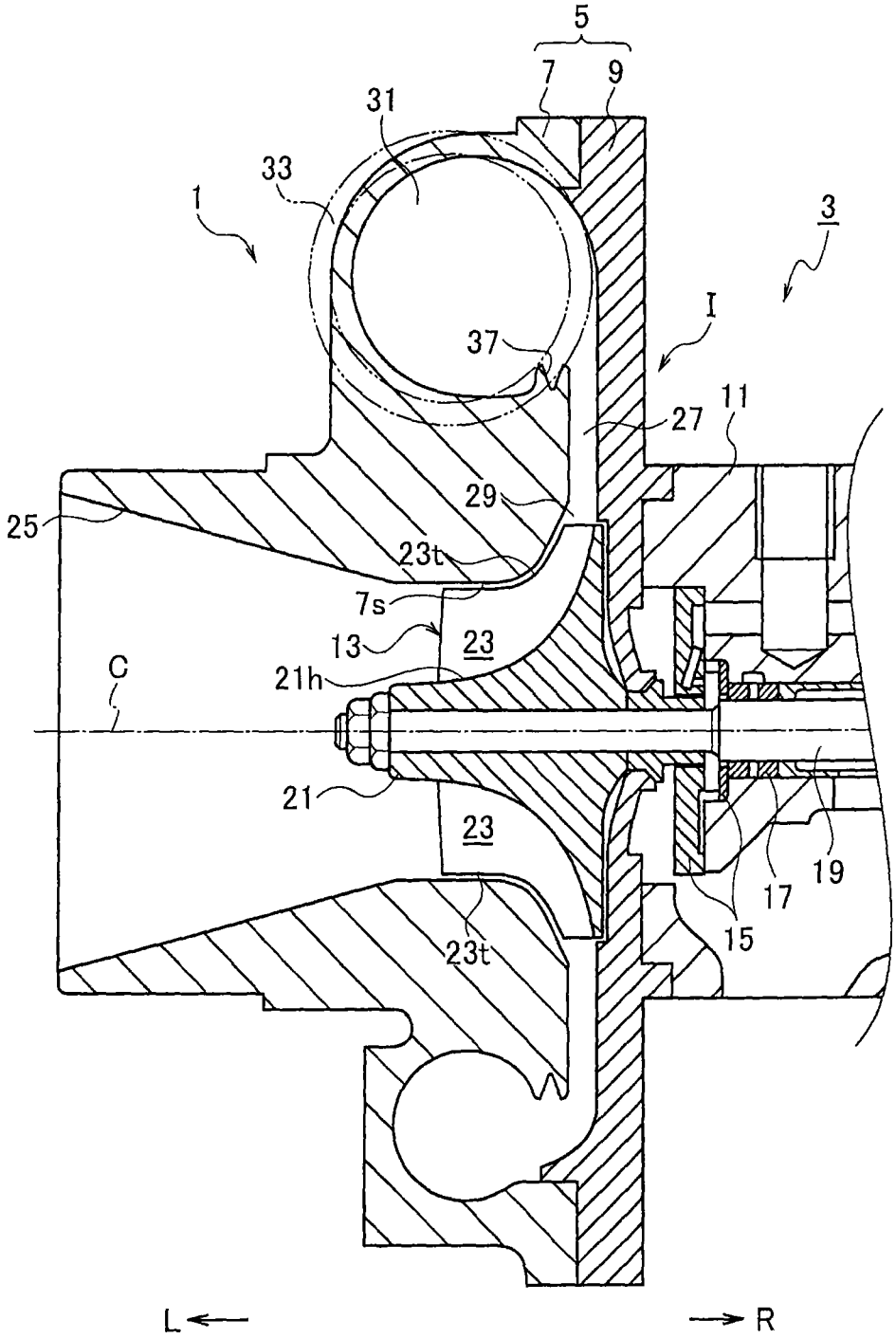
FIG. 3 is a front cross-sectional view showing a centrifugal compressor etc. according to an embodiment of the present disclosure.

As shown in FIGS. 1 and 3, a centrifugal compressor 1 according to the embodiment of the present disclosure is used for a turbocharger 3, and compresses air utilizing a centrifugal force.

The centrifugal compressor 1 includes a housing (a compressor housing) 5. The housing 5 includes a housing body 7 having a shroud 7*s* thereinside, and a seal plate 9 provided on a right side of the housing body 7. Note that the seal plate 9 is coupled integrally with another housing (a bearing housing) 11 in the turbocharger 3.

In the housing 5, the wheel (the compressor wheel) 13 is rotatably provided around an axial center C thereof. The wheel 13 is coupled integrally with a left end of a rotation shaft 19. The rotation shaft 19 is rotatably provided in the another housing 11 through a plurality of thrust bearings 15 and a plurality of (only one is shown) radial bearings 17. In addition, the wheel 13 includes a disk 21. The disk 21 has a hub surface 21*h*. The hub surface 21*h* extends outside in a radial direction (a radial direction of the wheel 13) from a left direction (one side in an axial direction of the wheel 13). Further, on the hub surface 21*h* of the disk 21, a plurality of blades 23 with a same axial length is integrally formed spaced apart from each other in a peripheral direction. A tip edge 23*t* of each blade 23 extends along the shroud 7*s* of the housing body 7. Note that plural types of blades (illustration is omitted) with different axial lengths may be used instead of using the plurality of blades 23 with the same axial length.

An introducing port (an introducing flow passage) 25 is formed on an inlet side of the wheel 13 in the housing body 7. The introducing port 25 introduces air into the housing 5. In addition, the introducing port 25 is connected to an air cleaner (illustration is omitted) that purifies the air. The diffuser (a diffuser flow passage) 27 is formed on an outlet side of the wheel 13 in the housing 5. The diffuser 27 decreases a velocity of compressed air (compression air) to thereby raise a pressure thereof. The diffuser 27 is, for example, formed annularly. A throttle part (a throttle flow passage) 29 is formed between the wheel 13 and the diffuser 27 in the housing 5. A flow passage width of the throttle part 29 becomes gradually smaller along the flow direction of the main flow. The throttle part 29 is, for example, formed annularly. The throttle part 29 communicates with the diffuser 27.

The scroll (the scroll flow passage) 31 is formed on an outlet side of the diffuser 27 in the housing 5. The scroll 31 is formed spirally. The scroll 31 communicates with the diffuser 27. A cross-sectional area of a winding end side (a downstream side) of the scroll 31 is larger than that of a winding start side (an upstream side) thereof. A discharge port (a discharge flow passage) 33 is formed in an appropriate position of the housing body 7. The discharge port 33 discharges compressed air outside the housing 5. The discharge port 33 communicates with the scroll 31, and is connected to an intake pipe (illustration is omitted) of an engine side, such as an intake manifold or an intercooler of an engine.

Figures 2A, 2B, 2C:
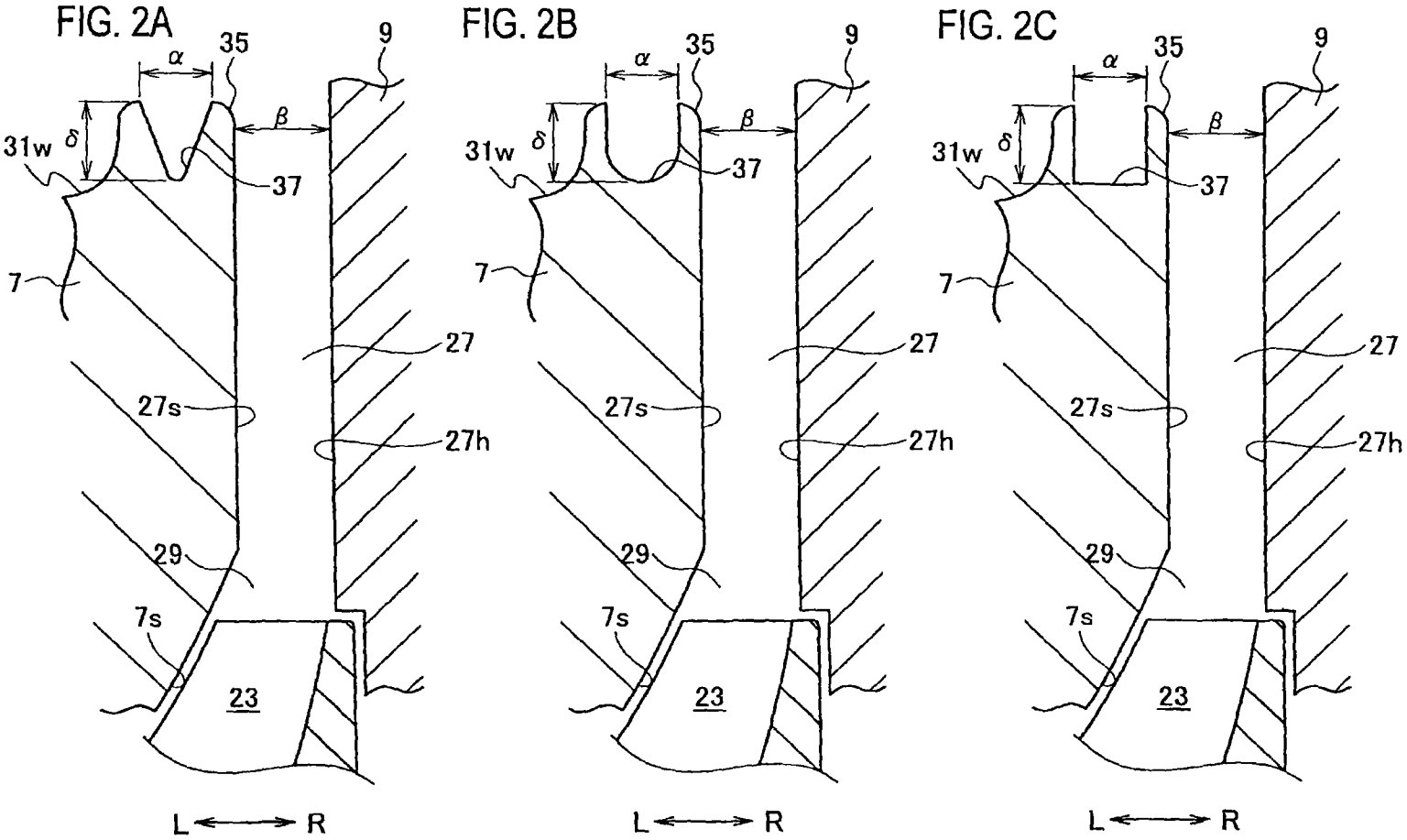
FIG. 2A is an enlarged view of an arrow part II in FIG. 1, and FIGS. 2B and 2C are views showing different aspects of a concave part.

As shown in FIGS. 1 and 2A, the shroud-side wall surface 27*s* and the hub-side wall surface 27*h* of the diffuser 27 are parallel to the radial direction (radial direction of the wheel 13), respectively. Note that the shroud-side wall surface 27*s* means a wall surface located on a side of a surface in which the shroud 7*s* of the housing body 7 has extended outside in the radial direction. The hub-side wall surface 27*h* means a wall surface located on a side of a surface in which the hub surface 21*h* of the disk 21 has extended outside in the radial direction.

The annular concave part 37 is formed in the boundary (boundary part) 35 between the shroud-side wall surface 27*s* of the diffuser 27 and the wall surface 31*w* of the scroll 31. The concave part 37 is depressed to the inside in the radial direction. The low pressure part LP due to flow separation (a separation vortex) is generated on the outlet 27*o* side of the diffuser 27 in the shroud-side wall surface 27*s*. The concave part 37 allows a part of the low pressure part LP to enter it. In addition, although a cross-sectional shape of the concave part 37 shown in FIG. 2A exhibits a V shape, the cross-sectional shape of the concave part 37 is not limited to this. Namely, the cross-sectional shape of the concave part 37 is appropriately changed, for example, exhibiting a U shape as shown in FIG. 2B or exhibiting a rectangular shape as shown in FIG. 2C. Further, as long as the annular concave part 37 is formed to be depressed to the inside in the radial direction, a cross-sectional center line of the concave part 37 may incline in the radial direction.

An opening width (an inlet width) α of the concave part 37 is set to be 20 to 80% of a flow passage width β of an outlet of the diffuser 27, and is preferably set to be 40 to 70% (0.20 to 0.80 times, and preferably, 0.40 to 0.70 times). It is because if the opening width α of the concave part 37 is less than 20% of the flow passage width β, it might be small, and the part of the low pressure part LP might be difficult to enter an inside of the concave part 37 that the opening width α is set to be not less than 20% of the flow passage width β. In addition, it is because if the opening width α exceeds 80% of the flow passage width β of the outlet of the diffuser 27, a part of the flow of the main flow in the scroll 31 enters the inside of the concave part 37, the pressure difference between the inside of the scroll 31 and the concave part 37 becomes small, and as a result, the part of the low pressure part LP might be difficult to enter the inside of the concave part 37 that the opening width α is set to be not more than 80% of the flow passage width β of the outlet of the diffuser 27.

A depression amount δ of the concave part 37 is set to be 0.5 to 5.0 times of the opening width α of the concave part 37, and is preferably set to be 2.0 to 3.0 times thereof. It is because if the depression amount δ is less than 0.5 times of the opening width α, it might be difficult to keep the low pressure part LP away from the flow of the main flow (the flow center line of the main flow) in the diffuser 27 and the scroll 31, even if the part of the low pressure part LP enters the inside of the concave part 37 that the depression amount δ is set to be not less than 0.5 times of the opening width α. In addition, it is because if the depression amount δ exceeds 5.0 times of the opening width α, the part of the flow of the main flow in the scroll 31 flows into the concave part 37, a stagnation pressure of a bottom side of the concave part 37 increases, and thereby the part of the low pressure part LP might be difficult to enter the inside of the concave part 37 that the depression amount δ is set to be not more than 5.0 times of the opening width α.

Subsequently, actions and effects of the embodiment of the present disclosure will be explained.

The wheel 13 is rotated integrally with the rotation shaft 19 around the axial center thereof by drive of a radial turbine (illustration is omitted) in the turbocharger 3, and thereby air introduced into the housing 5 from the introducing port 25 can be compressed. A pressure of the compressed air (compression air) is then raised, while a velocity thereof is decreased by the diffuser 27, and the compressed air whose pressure has been raised is discharged outside the housing 5 from the discharge port 33 via the scroll 31.

The annular concave part 37 is formed to be depressed to the inside in the radial direction in the boundary 35 between the shroud-side wall surface 27*s* of the diffuser 27 and the wall surface 31*w* of the scroll 31. Therefore, when the above-mentioned new knowledge is applied, the part of the low pressure part LP due to the flow separation (separation vortex) in the outlet 27*o* side of the diffuser 27 in the shroud-side wall surface 27*s* enters the inside of the annular concave part 37 during operation of the centrifugal compressor 1 (during operation of the turbocharger 3). As a result, the low pressure part LP can be kept away from the flow of the main flow (the flow centerline of the main flow) in the diffuser 27 and the scroll 31. In other words, the low pressure part LP can be displaced to a point that does not prevent the flow of the main flow in the diffuser 27 and the scroll 31.

Accordingly, according to the embodiment of the present disclosure, the low pressure part LP due to the flow separation of the outlet 27*o* side of the diffuser 27 in the shroud-side wall surface 27*s*, i.e., the separation itself, can be kept away from the flow of the main flow in the diffuser 27 during operation of the centrifugal compressor 1. Therefore, decrease of an effective flow passage area of the outlet 27*o* side of the diffuser 27 can be suppressed. Accordingly, a velocity of the flow of the main flow can be sufficiently decreased by the diffuser 27. In addition, the separation of the low pressure part LP due to the flow separation of the outlet 27*o* side of the diffuser 27 in the shroud-side wall surface 27*s* can be kept away from the flow of the main flow in the scroll 31. Accordingly, therefore, collision (interference) of the low pressure part LP and the flow of the main flow in the scroll 31 can be lessened to thereby suppress turbulence of the flow of the main flow in the discharge port 33 located on a downstream side of the scroll 31. Consequently, according to the present disclosure, improvement in compressor efficiency of the centrifugal compressor 1 can be achieved, while enhancing static pressure recovery performance of the diffuser 27.

Note that the present invention is not limited to the above-mentioned disclosure of the embodiment, and that it can be carried out in other various aspects, such as applying a technical idea applied to the centrifugal compressor 1 to a gas turbine, an industrial air facility, etc., or arranging a plurality of diffuser vanes (illustration is omitted) spaced apart from each other in a peripheral direction in the diffuser 27. In addition, the scope of right encompassed in the present invention is not limited to these embodiments.

EXAMPLES

Figure 6B:
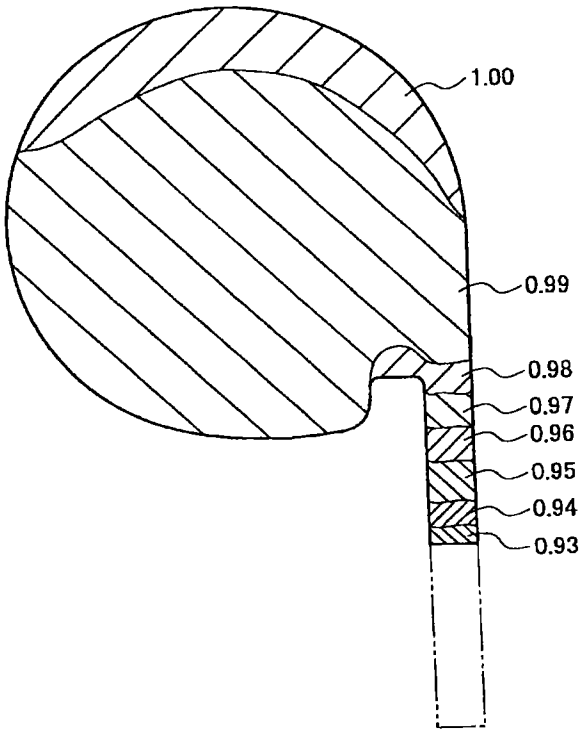
FIGS. 6A and 6B are views each showing static pressure distribution in a scroll and the diffuser in an actuating region of a small flow rate side (a surge side).
Figure 6A:
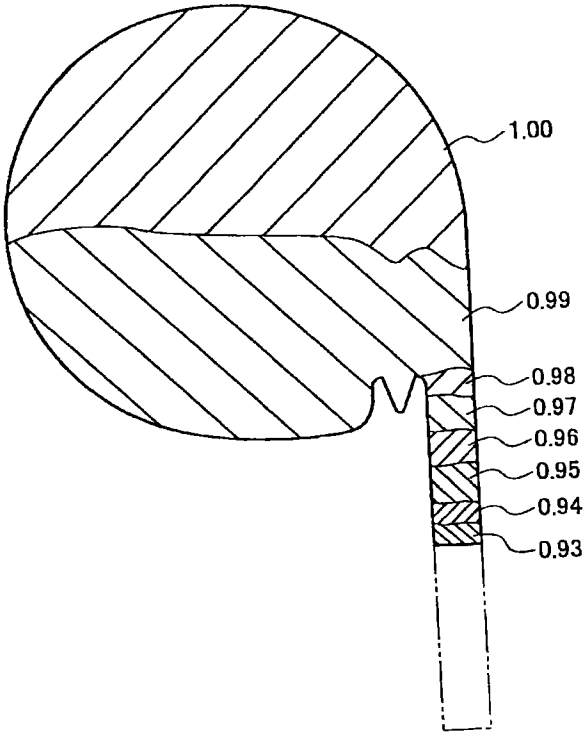
Figure 7:
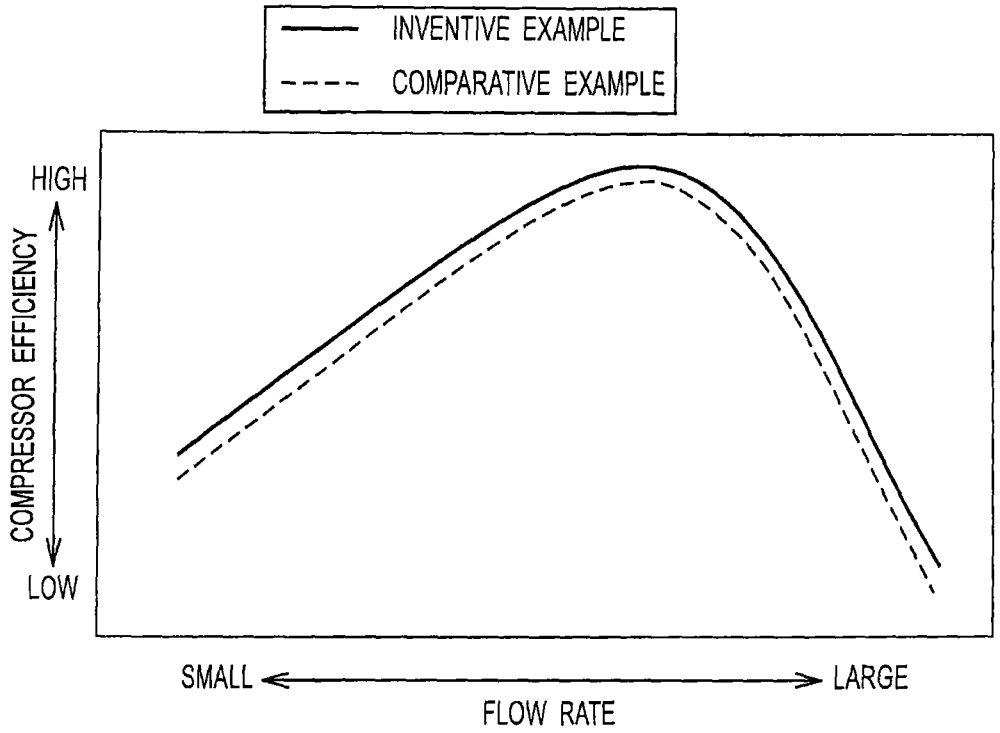
FIG. 7 is a graph showing relations between flow rates and compressor efficiency in cases of the inventive example and the comparative example.

Examples of the present disclosure will be explained with reference to FIGS. 6A, 6B, and 7.

CFD analysis of static pressure distribution in a scroll and a diffuser in an actuating region of a small flow rate side (a surge side) was performed to the inventive example (refer to FIG. 4A) and the comparative example (refer to FIG. 4B). As a result, it was confirmed that a static pressure in the scroll could be made to be higher as a whole in the inventive example shown in FIG. 6A, compared with the comparative example shown in FIG. 6B. In other words, it was confirmed that static pressure recovery performance of the diffuser could be made to be higher in the inventive example. In addition, although illustration is omitted, similar analysis results could be obtained not only in the actuating region of the small flow rate side but also in actuating regions of a large flow rate side and near a peak of compressor efficiency. Note that numerical values in FIGS. 6A and 6B show dimensionless static pressures in the scroll.

There was performed CFD analysis of a relation between a flow rate and compressor efficiency in the inventive example (refer to FIG. 4A) and the comparative example (refer to FIG. 4B). As a result, as shown in FIG. 7, it was confirmed that compressor efficiency was more improved in a wide actuating region from the small flow rate side to the large flow rate side in the inventive example compared with the comparative example.

What is claimed is:

1. A centrifugal compressor that compresses a fluid utilizing a centrifugal force, comprising:

a housing having a shroud thereinside;

a wheel rotatably provided in the housing;

a diffuser formed outside in a radial direction of an outlet side of the wheel in the housing;

a scroll that is formed on an outlet side of the diffuser in the housing, and communicates with the diffuser; and a concave part in a boundary between a shroud-side wall surface of the diffuser and a wall surface of the scroll, the concave part including an inner surface depressed radially inward in a radial direction of the wheel and integrally formed with the shroud-side wall surface of the diffuser on a first side of the inner surface and with the wall surface of the scroll on a second side of the inner surface, wherein a depression amount of the concave part is set to be 0.5 to 5.0 times of an opening width of the concave part.

2. The centrifugal compressor according to claim 1, wherein the opening width of the concave part is set to be 20% to 80% of a flow passage width of an outlet of the diffuser.

3. The centrifugal compressor according to claim 1, wherein the concave part is formed annularly.

4. The centrifugal compressor according to claim 2, wherein the concave part is formed annularly.

5. A turbocharger comprising the centrifugal compressor according to claim 1.

* * * * *